US008023851B2

(12) United States Patent
Cao et al.

(10) Patent No.: US 8,023,851 B2
(45) Date of Patent: Sep. 20, 2011

(54) METHOD AND PRINTER ASSEMBLY FOR CONSISTENT POWER CONTROL IN FUSER ASSEMBLY OF ELECTROPHOTOGRAPHIC PRINTER

(75) Inventors: Jichang Cao, Lexington, KY (US); William Paul Cook, Lexington, KY (US); Hrishikesh Pramod Gogate, Lexington, KY (US); Wesley David McIntire, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 328 days.

(21) Appl. No.: 12/175,849

(22) Filed: Jul. 18, 2008

(65) Prior Publication Data

US 2010/0014881 A1 Jan. 21, 2010

(51) Int. Cl.
*G03G 15/20* (2006.01)

(52) U.S. Cl. ..... 399/69; 399/70

(58) Field of Classification Search ..... 399/69, 399/70, 328, 330, 335; 219/216
See application file for complete search history.

(56) References Cited

U.S. PATENT DOCUMENTS

| | | | | |
|---|---|---|---|---|
| 5,899,599 | A * | 5/1999 | Kato | 399/69 |
| 5,987,275 | A * | 11/1999 | Toyohara et al. | 399/70 |
| 6,101,346 | A * | 8/2000 | Arakawa | 399/70 |
| 6,927,368 | B2 | 8/2005 | Cao et al. | |
| 6,999,693 | B2 * | 2/2006 | Ota | 399/70 |
| 7,235,761 | B1 | 6/2007 | Maul et al. | |
| 7,254,352 | B2 * | 8/2007 | Lee | 399/69 |
| 7,664,417 | B2 * | 2/2010 | Hori et al. | 399/69 |
| 2005/0105929 | A1 | 5/2005 | Chae et al. | |
| 2006/0127119 | A1 | 6/2006 | Sato | |
| 2007/0059001 | A1 | 3/2007 | Matsuura et al. | |
| 2007/0059022 | A1 | 3/2007 | Yamaoka et al. | |
| 2007/0196119 | A1 | 8/2007 | Fujita | |
| 2009/0139982 | A1 * | 6/2009 | Cao et al. | 219/492 |
| 2009/0142086 | A1 | 6/2009 | Cao et al. | |
| 2009/0238597 | A1 * | 9/2009 | Cao et al. | 399/70 |
| 2009/0245839 | A1 | 10/2009 | Cook et al. | |

FOREIGN PATENT DOCUMENTS

GB 2258844 A * 2/1993

OTHER PUBLICATIONS

Machine Translation of JP 2003-0330,298, to Oka et al., Nov. 19, 2003.

* cited by examiner

*Primary Examiner* — Robert Beatty

(57) ABSTRACT

A method for setting a heater element of a fuser assembly to a consistent starting condition to achieve consistency in heating power measurement is provided. The heater element is heated to a first predefined temperature when the temperature of the heater element is less than the first predefined temperature. The temperature of the heater element is maintained within a predefined range for a predefined period of time. This sets the temperature of the heater element in the fuser assembly to a consistent starting condition. Thereafter, the heating power estimation measurement is made and heating power supplied to the fuser assembly is estimated. This controls the heating power delivered to the fuser assembly in a consistent manner.

14 Claims, 3 Drawing Sheets

METHOD AND PRINTER ASSEMBLY FOR CONSISTENT POWER CONTROL IN FUSER ASSEMBLY OF ELECTROPHOTOGRAPHIC PRINTER

CROSS REFERENCES TO RELATED APPLICATIONS

This patent application is related to the U.S. patent application Ser. No. 11/946,948, filed Nov. 29, 2007, entitled "Heating Power Estimation for Color Belt Fuser" and assigned to the assignee of the present application.

BACKGROUND

1. Field of the Invention

The present invention relates to electrophotographic printers. In particular, the present invention relates to a method for controlling power delivered to a fuser assembly of an electrophotographic printer.

2. Description of the Related Art

It is desirable for image forming devices such as printers and scanners to be able to operate in a proper manner irrespective of the variations in the supply line voltage. For proper functioning, it is required that adequate power be supplied to a fuser assembly of an electrophotographic printer to increase the temperature of a heater element in the fuser assembly and enable generation of images soon after powering up the printer. At the same time, it needs to be ensured that excessive power is not delivered to the fuser assembly, since it may result in a catastrophic damage. Therefore, there is a need to control the power delivered to the fuser assembly to account for variations in the supply line voltage and electrical components.

U.S. patent application Ser. No. 11/946,948 describes a method for estimating the heating power delivered to the heater element of the fuser assembly of an image forming device. The method includes application of a predefined portion of a source power to the heater element. Based on this, the rate of increase in temperature of the heater element while being heated from one predefined temperature to another predefined temperature is determined. The rate of increase in the temperature is used to calculate the heating power at the line voltage. Thereafter, the calculated heating power is scaled by a 'power ratio' to a baseline heating power configured for proper functioning of the fuser assembly.

For example, 30 percent of the source power is applied to the heater element for heating the heater element of fuser assembly. The heater element is heated from 60° C. to 90° C. The rate of increase in the temperature of the heater element while being heated from 60° C. to 90° C. is measured. Based on the rate of increase in the temperature, the heating power at the line voltage is calculated to be 1200 W. Thereafter, the calculated heating power is scaled to the baseline heating power for the fuser assembly set to 800 W. The 'power ratio' for scaling the calculated heating power is determined as given in Equation 1:

$$PowerRatio \equiv \frac{800}{1200} \times 100\% \quad (1)$$

Power ratio is thus determined to be 66.67 percent from Equation 1.

However, the method described above shows inconsistent results at a constant supply voltage. Empirical tests reveal that the calculated heating power measures higher when the starting temperature of the heater element of the fuser assembly is higher. Table 1 depicts the power ratio that is used to scale the calculated heating power over a series of high and low start temperatures of the heater element of the fuser assembly. Table 2 shows the difference in the power ratio determined at different temperatures of the heater element depicted in Table 1 while keeping the input voltage at a constant level.

TABLE 1

Heating power estimation

| AC INPUT | LOW START TEMPERATURE | | HIGH START TEMPERATURE | |
|---|---|---|---|---|
| VOLTAGE (V) | TEMPERATURE (° C.) | POWER RATIO (%) | TEMPERATURE (° C.) | POWER RATIO (%) |
| 90 | 21 | 183.415 | 43 | 159.495 |
| 115 | 25 | 108.305 | 46 | 95.202 |
| 135 | 26 | 77.074 | 46 | 70.434 |

TABLE 2

Inconsistency in heating power estimation

| AC INPUT VOLTAGE | DIFFERENCE | |
|---|---|---|
| (V) | TEMPERATURE (° C.) | POWER RATIO (%) |
| 90 | 22 | −23.92 |
| 115 | 21 | −13.003 |
| 135 | 20 | −6.64 |

For example, at an AC input voltage of 90V, the power ratio is determined to be 183.415 percent at 21° C. and 159.495 percent at 43° C. The difference in the determined power ratio is almost 24 percent over a difference of 22° C. in the temperature of the heater element.

The tests indicate that the initial temperature of the heater element was not taken into consideration while estimating the heating power delivered to the heater element of the fuser assembly.

In light of the foregoing, there is a need to achieve consistency in heating power estimation of the fuser assembly irrespective of the initial temperature of the heater element.

SUMMARY OF THE INVENTION

A method for setting a heater element of a fuser assembly to a consistent starting condition is provided. The heater element temperature is measured. If the temperature of the heater element in the fuser assembly is less than a first predefined temperature, the heater element is heated to the first predefined temperature by applying a portion of a source power. Further, the temperature of the heater element is maintained within a predefined range of the first predefined temperature for a predefined period of time. This sets the temperature of the heater element to a consistent starting condition. Thereafter, the heating power estimation measurement is made and the heating power is applied to the heater element accordingly. The estimated heating power is also stored. If the temperature of the heater element in the fuser assembly is more than the first predefined temperature, the heater element is heated according to a previous heating power estimate. The heating power estimation measurement method is described in detail in U.S. patent application Ser. No. 11/946,948.

Since the heater element is set to a consistent starting condition before making the heating power estimation measurement, the energy stored in the heater element of the fuser assembly contributes to the heating power required to heat the heater element in a predictable manner. This ensures that the contribution of the starting condition of the heater element of the fuser assembly is factored in the heating power estimation measurement. Therefore, this method facilitates consistent power control irrespective of the initial temperature of the heater element.

BRIEF DESCRIPTION OF DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION OF DRAWINGS

Figure 1:
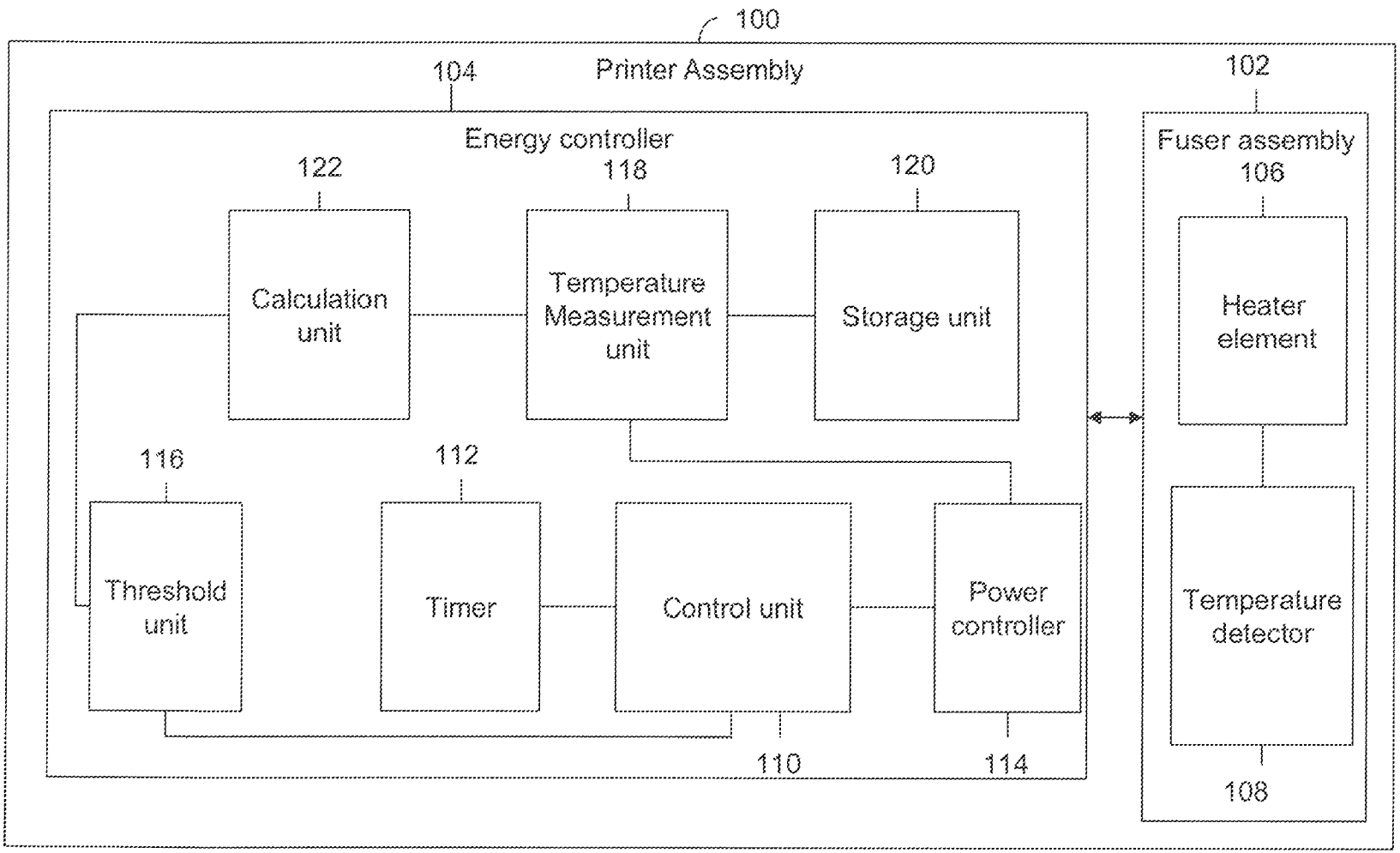
FIG. 1 is a block diagram of a printer assembly, in accordance with an embodiment of the present invention; and FIG. 2A

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," "containing", or "having" and variations thereof herein is meant to encompass the items listed thereafter and equivalents thereof as well as additional items. Unless limited otherwise, the terms "connected," "coupled," and variations thereof herein are used broadly and encompass direct and indirect connections, couplings, and mountings. In addition, the terms "connected" and "coupled" and variations thereof are not restricted to physical or mechanical connections or couplings.

The present invention relates to a method for setting the heater element of the fuser assembly to a consistent starting condition. The method includes applying power to a heater element in the fuser assembly for heating the heater element to a first predefined temperature and maintaining the temperature of the heater element. The temperature of the heater element is maintained within a predefined range for a predefined period of time. This sets the heater element of the fuser assembly to a consistent starting condition.

FIG. 1 is a block diagram of a printer assembly 100, in accordance with an embodiment of the present invention. Printer assembly 100 includes a fuser assembly 102 and an energy controller 104. Fuser assembly 102 includes a heater element 106 and a temperature detector 108. Energy controller 104 includes a control unit 110, a timer 112, a power controller 114, a threshold unit 116, a temperature measurement unit 118, a storage unit 120 and a calculation unit 122.

Heater element 106 is connected to temperature detector 108 for measuring the temperature of heater element 106. In various embodiments of the present invention, temperature detector 108 may be a thermistor, a resistance temperature detector, and the like. Energy controller 104 controls power delivered to heater element 106. In an embodiment of the invention, if the temperature of heater element 106 is less than a second predefined temperature, such as 45° C., control unit 110 raises the temperature of heater element 106 to the first predefined temperature, such as 50° C. and sets heater element 106 of fuser assembly 102 to a consistent starting condition. In another embodiment of the invention, the first predefined temperature and the second predefined temperature can be equal. For example, the first and second predefined temperatures can both be 45° C. Thus, control unit 110 will raise the temperature of heater element 106 to 45° C. if the temperature of heater element 106 is found to be less than 45° C.

Control unit 110 included in energy controller 104 is connected to power controller 114 for supplying a first predefined portion of a source power to heater element 106 for heating heater element 106 of fuser assembly 102. The power applied to heater element 106 heats heater element 106 to the first predefined temperature. Further, control unit 110 maintains the temperature of heater element 106 within a predefined range of the first predefined temperature. Timer 112 is connected to control unit 110 for maintaining the temperature of heater element 106 for a predefined period of time. Control unit 110 heats heater element 106 to the first predefined temperature and maintains the temperature of heater element 106 within a predefined range of temperature for a predefined period of time. This results in absorption of energy by heater element 106 thereby setting heater element 106 of fuser assembly 102 to a consistent starting condition. This method is explained in detail in conjunction with FIG. 2.

The values of the first predefined portion of the source power and the first predefined temperature are received at control unit 110 through threshold unit 116. Control unit 110 also receives the predefined range of temperature and predefined period of time from threshold unit 116 for maintaining the temperature of heater element 106. In an embodiment of the present invention, the first predefined portion of the source power may be in the range of 25 percent to 30 percent of the source power. In another embodiment of the present invention, the first predefined temperature may be in the range of 45° C. to 50° C.

In an embodiment of the present invention, heater element 106 may be heated to a first predefined temperature when the temperature of heater element 106 is less than a second predefined temperature. For example, temperature of heater element 106 may be detected to be 41° C. As 41° C. temperature is less than the second predefined temperature of 45° C., control unit 110 applies power to heater element 106 for heating heater element 106 to the first predefined temperature of 50° C. Thereafter, control unit 110 maintains the temperature of heater element 106 within a predefined range of the first predefined temperature of 50° C., such as a predefined range of 48° C. and 52° C. The temperature of heater element 106 is maintained within this range for a predefined period of time. This sets heater element 106 of fuser assembly 102 to a consistent starting condition.

In another embodiment of the invention, the first predefined temperature and the second predefined temperature can be equal. For example, the first predefined temperature and the second predefined temperature have the same value as 45° C. Thus, in an exemplary embodiment of the invention, temperature detector 108 may detect the temperature of heater element 106 to be 41° C. As the temperature of heater element 106 is less than the first predefined temperature of 45° C., control unit 110 applies 29 percent of the source power to heater element 106 for heating heater element 106 to 45° C. Further, control unit 110 maintains the temperature of heater element 106 within a predefined range of 45° C., for example, the temperature of heater element 106 is maintained within a range of 43° C. and 47° C., i.e., +/−2° C. The temperature of heater element 106 is maintained within the range of first predefined temperature for a predefined period of time, for example, the temperature is maintained between 43° C. and 47° C. for a time period of 3.5 seconds. This sets heater element 106 of fuser assembly 102 to a consistent starting condition.

After heater element 106 of fuser assembly 102 is set to a consistent starting condition, heating power delivered to heater element 106 is estimated. Temperature measurement unit 118 applies a second predefined portion of the source power to heater element 106 through power controller 114 for heating heater element 106 of fuser assembly 102. Further, temperature measurement unit 118 measures a rate of increase in the temperature of heater element 106 when heater element 106 is heated from a third predefined temperature to a fourth predefined temperature. The rate of increase in the temperature is saved in storage unit 120 for subsequent reference. In an embodiment of the present invention, the second predefined portion of the source power may be the same as the first predefined portion of the source power. In an embodiment of the present invention, the third predefined temperature may be 60° C. and the fourth predefined temperature may be 90° C.

Calculation unit 122 receives the rate of increase in the temperature of heater element 106 as an input from temperature measurement unit 118 to estimate the AC line voltage and corresponding heating power supplied to heater element 106. Thereafter, the estimated source heating power is compared with a baseline heating power configured for the proper functioning of fuser assembly 102. The ratio of the estimated heating power and the baseline heating power is determined to scale the estimated source heating power before applying it to heater element 106. In this manner, the heating power delivered to heater element 106 for heating heater element 106 of fuser assembly 102 is controlled. This method is discussed in detail in U.S. patent application Ser. No. 11/946,948.

When the temperature of heater element 106 is more than the first predefined temperature, heater element 106 is heated according to a previous heating power estimate. The previous heating power estimate is determined from a previously stored rate of increase in the temperature of heater element 106 retrieved from storage unit 120.

Figure 2A:
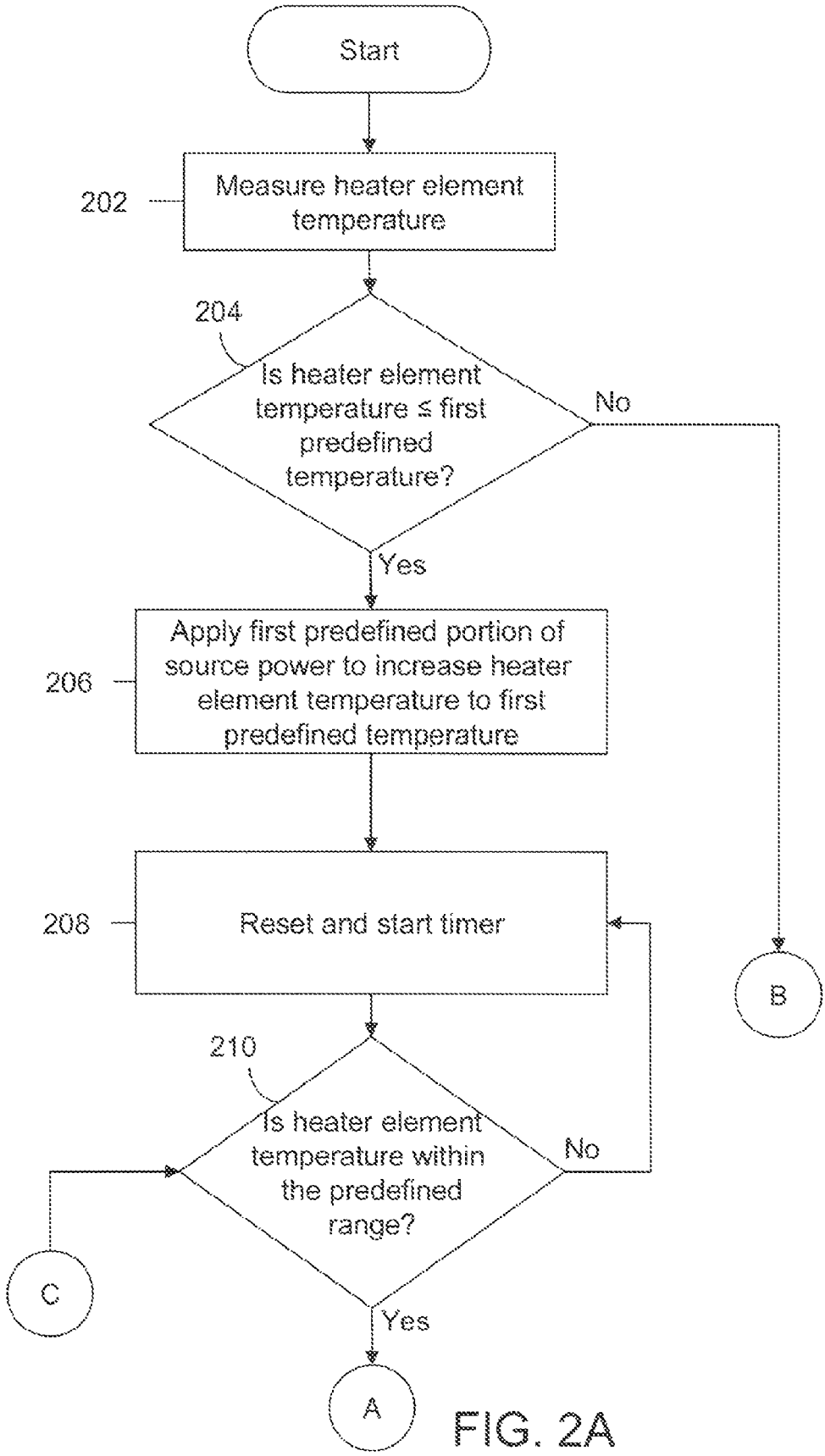
FIG. 2B is a flowchart illustrating a method for setting a heater element of a fuser assembly constituted in a printer assembly to a consistent starting condition, in accordance with an embodiment of the present invention.
Figure 2B:
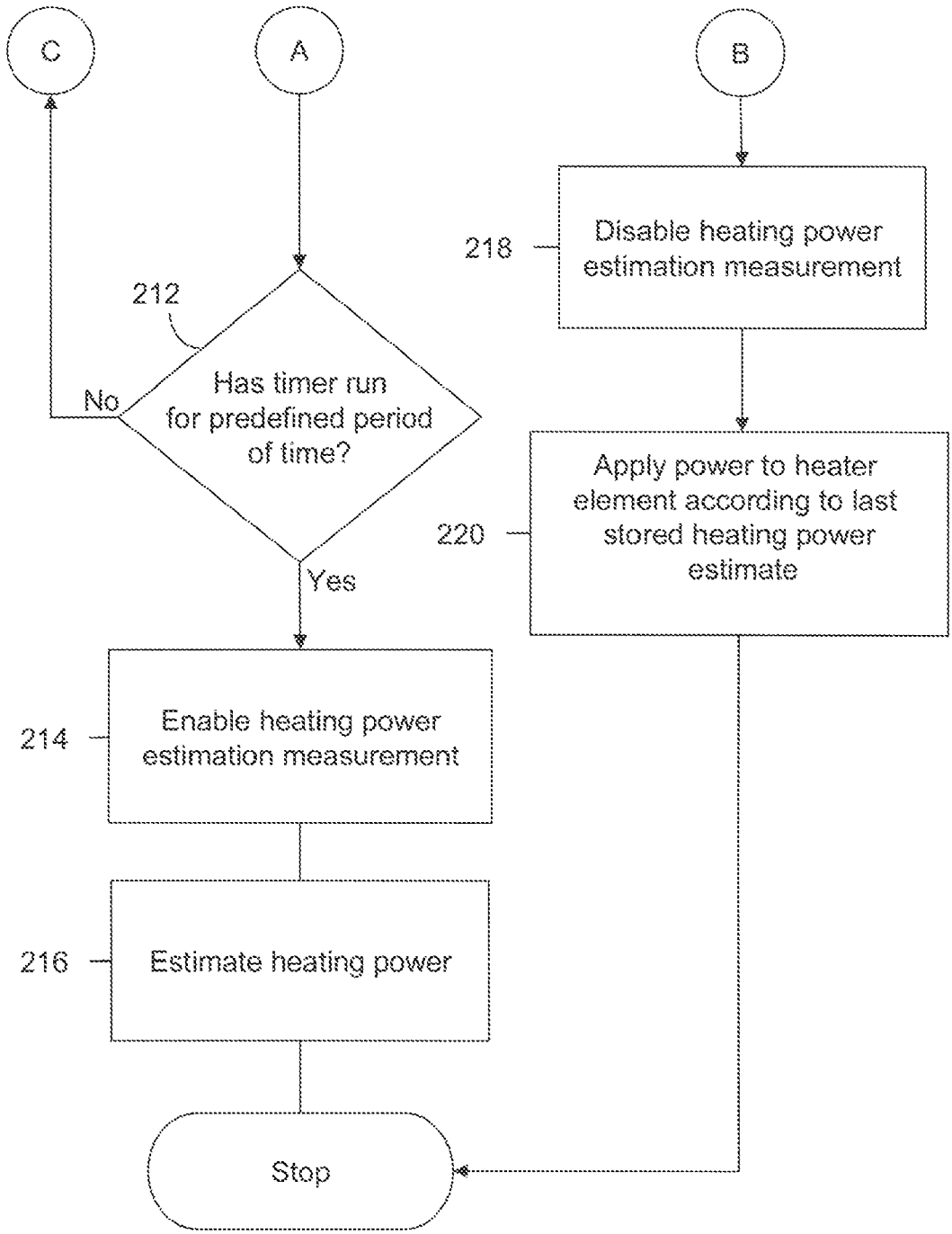

FIG. 2A and FIG. 2B is a flowchart illustrating a method for setting a heater element, such as heater element 106 of a fuser assembly, such as fuser assembly 102, constituted in a printer assembly, such as printer assembly 100, to a consistent starting condition, in accordance with an embodiment of the present invention. At 202, the temperature of the heater element is measured. The heater element temperature is compared with a first predefined temperature at 204. If the heater element temperature is less than or equal to the first predefined temperature, then, at 206, a first predefined portion of the source power is applied to the heater element to heat the heater element of the fuser assembly to the first predefined temperature. When the heater element attains the first predefined temperature, a timer is started at 208 to maintain the temperature of the heater element within the predefined range of temperature for a predefined period of time. At 210, it is checked if the heater element temperature is within the predefined range of temperature. If the heater element temperature is within the predefined range of temperature, then, at 212, the duration for which the timer has run is compared with the predefined period of time. If the timer has not run for the predefined period of time, the heater element temperature is again checked to be within the predefined range of temperature at 210. If the heater element temperature is not within the predefined range of temperature, the timer is reset at 208. Once the heater element temperature is maintained within the predefined range of the first predefined temperature and the timer has run for the predefined period of time at 212, the heating power estimation measurement is enabled at 214. Thereafter, heating power is estimated at 216. The method for the heating power estimation measurement has been explained briefly in conjunction with FIG. 1 and is discussed in detail in U.S. patent application Ser. No. 11/946,948.

At 204, if the heater element temperature is more than the first predefined temperature, the heating power estimation measurement is disabled at 218. Subsequently, at 220, power is applied to the heater element in the fuser assembly according to a previous heating power estimate stored in a storage unit, such as storage unit 120. This method enables consistent measurement of heating power for controlling the heating power delivered to the heater element of the fuser assembly.

In an embodiment of the present invention, an excessive wattage check is performed for the fuser assembly while estimating heating power delivered to the heater element. Different fuser assemblies are intended for use over different ranges of supply voltage. The excessive wattage check determines if the fuser assembly is of the correct type and is capable of being used over the available supply voltage. In another embodiment of the present invention, an excessive wattage check may be performed before the heating power estimation measurement.

Empirical tests reveal that the method for consistent measurement of heating power described above reduces the inconsistency introduced on account of the starting temperature of the heater element in the fuser assembly. Table 3 shows the power ratio that is used to scale the calculated heating power determined from the consistent heating power measurement over a series of high and low start temperatures of the heater element. Table 4 shows the difference in the power ratio determined at different temperatures of the heater element keeping the input voltage at a constant level.

TABLE 3

Heating power estimation using consistent measurement

| AC INPUT | LOW START TEMPERATURE | | HIGH START TEMPERATURE | |
|---|---|---|---|---|
| VOLTAGE (V) | TEMPERATURE (° C.) | POWER RATIO (%) | TEMPERATURE (° C.) | POWER RATIO (%) |
| 90 | 22 | 164.465 | 41 | 157.875 |
| 115 | 20 | 100.679 | 41 | 96.856 |
| 135 | 23 | 72.292 | 42 | 70.995 |

TABLE 4

Inconsistency in heating power estimation using consistent measurement

| AC INPUT VOLTAGE | DIFFERENCE | |
|---|---|---|
| (V) | TEMPERATURE (° C.) | POWER RATIO (%) |
| 90 | 19 | −6.590 |
| 115 | 21 | −3.823 |
| 135 | 19 | −1.297 |

On normalizing the temperature difference to 20° C., the difference in the power ratio using the consistent heating power measurement and using the method described in U.S. patent application Ser. No. 11/946,948 is determined. Table 5 shows the comparison of power ratio with the difference in temperature normalized to 20° C.

TABLE 5

Comparison of power ratio with temperature difference normalized

| AC INPUT VOLTAGE (V) | POWER RATIO NORMALISED TO 20° C. (%) WITHOUT CONSISTENT HEATING POWER MEASUREMENT | WITH CONSISTENT HEATING POWER MEASUREMENT | DIFFERENCE (%) |
|---|---|---|---|
| 90 | −21.745 | −6.937 | 68.1 |
| 115 | −12.384 | −3.641 | 70.5 |
| 135 | −6.640 | −1.365 | 79.4 |

It is observed that the inconsistency is reduced by nearly 80 percent at an AC input voltage of 135V by using consistent heating power measurement. Further, the difference in the power ratio over a series of high and low temperatures is not more than 7 percent under any AC input voltage when consistent heating power measurement is used. Hence, the present invention provides a consistent method for controlling the power delivered to the heater element of the fuser assembly.

The method and system for setting a heater element of a fuser assembly to a consistent starting condition and controlling power delivered to a heater element in a fuser assembly, as described in the present invention or any of its components, may be embodied in the form of a computer readable program code for a computer system. Typical examples of a computer system includes a general-purpose computer, a programmed microprocessor, a micro-controller, a peripheral integrated circuit element, and other devices or arrangements of devices that are capable of implementing the steps that constitute the method of the present invention.

The computer system executes a set of instructions that are stored in one or more computer usable mediums, in order to process input data. The storage elements may also hold data or other information as desired. The storage element may be in the form of an information source or a physical memory element present in the processing machine.

The set of program instruction means may include various commands that instruct the processing machine to perform specific tasks such as the steps that constitute the method of the present invention. The set of instructions may be in the form of a software program. Further, the software may be in the form of a collection of separate programs, a program module with a larger program or a portion of a program module, as in the present invention. The software may also include modular programming in the form of object-oriented programming. The processing of input data by the processing machine may be in response to user commands, results of previous processing or a request made by another processing machine.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for setting a heater element of a fuser assembly to a substantially consistent starting condition, the method comprising:

measuring temperature of the heater element in the fuser assembly;

applying a source power to the heater element for heating the heater element to a first predefined temperature when the temperature of the heater element is less than a second predefined temperature, the second predefined temperature being less than or equal to the first predefined temperature; and maintaining the temperature of the heater element within a predefined range of the first predefined temperature, wherein the maintenance of temperature within the predefined range sets the heater element of the fuser assembly to the substantially consistent starting condition; and estimating heating power delivered to the heater element after the maintaining of the temperature of the heater element.

2. The method according to claim 1 further comprising maintaining the temperature of the heater element within the predefined range for a predefined period of time.

3. The method according to claim 1, wherein the act of estimating heating power comprises:

heating the heater element from a third predefined temperature to a fourth predefined temperature, the fourth predefined temperature being higher than the third predefined temperature and the third predefined temperature being higher than the first predefined temperature;

measuring an elapsed time for the temperature of the heater element to rise from the third predefined temperature to the fourth predefined temperature;

determining the rate of temperature increase of the heater element based on the elapsed time; and calculating the heating power delivered to the heater element based on the rate of temperature increase of the heater element.

4. A method for controlling power delivered to a heater element in a fuser assembly constituted in an electrophotographic printer, the method comprising:

measuring temperature of the heater element;

applying a first predefined portion of a source power to the heater element for heating the heater element in the fuser assembly to a first predefined temperature when the temperature of the heater element is less than the first predefined temperature;

maintaining the temperature of the heater element within a predefined range of the first predefined temperature for a predefined period of time, wherein the maintenance of temperature sets the heater element in the fuser assembly to a substantially consistent starting condition;

heating the heater element from a second predefined temperature to a third predefined temperature, the third predefined temperature being higher than the second predefined temperature and the second predefined temperature being higher than the first predefined temperature;

measuring an elapsed time for the temperature of the heater element to rise from the second predefined temperature to the third predefined temperature;

determining a rate of temperature increase of the heater element based on the elapsed time; and estimating heating power delivered to the heater element after the heater element in the fuser assembly is set to the substantially consistent starting condition, wherein the heating power estimation controls the power delivered to the heater element.

5. The method according to claim 4, wherein the heater element is heated with a second predefined portion of the source power for determining the rate of temperature increase.

6. The method according to claim 4 wherein the estimating of the heating power delivered to the heater element is based on the rate of temperature increase of the heater element.

7. The method according to claim 6 further comprising applying a portion of source heating power to the heater element based on the calculated heating power.

8. The method according to claim 4 further comprising storing the elapsed time period.

9. The method according to claim 8 further comprising heating the heater element according to a last stored elapsed time period when the temperature of the heater element is more than the first predefined temperature.

10. A printer assembly for use in an electrophotographic printer, the printer assembly comprising:

a fuser assembly comprising:

a heater element; and a temperature detector connected to the heater element for measuring temperature of the heater element; and an energy controller for controlling power delivered to the heater element of the fuser assembly, the energy controller comprising:

a control unit coupled to the temperature detector for setting the heater element of the fuser assembly to a first starting condition; and a timer coupled to the control unit for maintaining the temperature of the heater element within a predefined range of a first predefined temperature for a predefined period of time, wherein the maintenance of temperature within the predefined range sets the heater element of the fuser assembly to the first starting condition;

wherein the energy controller heats the heater element from a second predefined temperature to a third predefined temperature, the third predefined temperature being higher than the second predefined temperature and the second predefined temperature being higher than the first predefined temperature; and wherein the energy controller measures a rate of temperature increase of the heater element based on an elapsed time when the heater element is heated from the second predefined temperature to the third predefined temperature.

11. The printer assembly according to claim 10, wherein the energy controller further comprises a threshold unit for setting the predefined range, the predefined period of time and the first predefined temperature.

12. The printer assembly according to claim 10, wherein the energy controller further comprises a power controller for supplying a first predefined portion of a source power to the energy controller for heating the heater element.

13. The printer assembly according to claim 10, wherein the energy controller further comprises a calculation unit coupled to the temperature measurement unit for calculating the heating power delivered to the heater element.

14. The printer assembly according to claim 10, wherein the energy controller further comprises a storage unit for storing the elapsed time period.

* * * * *